US006105774A

United States Patent [19]

Jackson

[11] Patent Number: 6,105,774

[45] Date of Patent: Aug. 22, 2000

[54] CARTON FOR PACKAGING CONTAINERS

[76] Inventor: Lisa Jackson, 15215 Friends St., Pacific Palisades, Calif. 90272

[21] Appl. No.: 09/285,187

[22] Filed: Mar. 31, 1999

[51] Int. Cl.[7] ..... B65D 65/00; B65D 85/62; B65D 5/475

[52] U.S. Cl. ..... 206/434; 206/428; 206/430; 206/499; 229/117.13

[58] Field of Search ..... 206/427, 428, 206/430, 434, 499; 229/117.13

[56] References Cited

U.S. PATENT DOCUMENTS

| | | | |
|---|---|---|---|
| 3,209,982 | 10/1965 | Laster et al. | 206/428 X |
| 3,391,781 | 7/1968 | Jorgensen | 206/499 |
| 3,827,614 | 8/1974 | Baxter et al. . | |
| 4,049,189 | 9/1977 | Wood | 206/427 X |
| 4,756,419 | 7/1988 | Le Bras | 206/430 |
| 4,804,089 | 2/1989 | Wilson . | |
| 4,901,849 | 2/1990 | Wilson . | |
| 4,919,266 | 4/1990 | McIntosh, Jr. et al. | 206/434 |
| 5,230,425 | 7/1993 | Edqvist et al. . | |
| 5,482,203 | 1/1996 | Stout | 229/117.13 |
| 5,484,059 | 1/1996 | Sutherland . | |
| 5,485,915 | 1/1996 | Harris . | |
| 5,524,756 | 6/1996 | Sutherland . | |
| 5,531,319 | 7/1996 | Harrelson . | |
| 5,538,130 | 7/1996 | Harrelson . | |
| 5,549,197 | 8/1996 | Sutherland . | |
| 5,611,431 | 3/1997 | Harris . | |
| 5,638,956 | 6/1997 | Sutherland . | |
| 5,687,838 | 11/1997 | Bakx . | |
| 5,704,470 | 1/1998 | Sutherland . | |
| 5,772,030 | 6/1998 | Baxter . | |

FOREIGN PATENT DOCUMENTS

| | | | |
|---|---|---|---|
| 2447872 | 8/1980 | France | 206/428 |
| 2807184 | 8/1978 | Germany | 206/434 |

*Primary Examiner*—Bryon P. Gehman

[57] ABSTRACT

An article carrier that is specially designed to permit easy packaging of articles such as pet food containers in a three-tier array. The article carrier is easy to assemble from the formed blank, and when assembled provides a sturdy structure which can be easily transported and stored. The assembled structure is such that substantial portions of the packaged article are exposed to view without degrading the overall structural integrity of the carrier.

12 Claims, 5 Drawing Sheets

CARTON FOR PACKAGING CONTAINERS

BACKGROUND OF THE INVENTION

1. Field of the Invention

The present invention relates generally to packaging arts. More particularly, the invention concerns a paper board carton for use in packaging containers containing pet food, wherein the containers are stacked in three tiers.

2. Discussion of the Prior Art

Numerous types of containers are commonly sold in multiple quantities and are packaged in cartons of a wide variety of designs. Common types of article packages include wrap around article containers, basket style carriers and sleeve type carriers. Basket style carriers are commonly employed to package beverage bottles cans and like articles. Such carriers typically include a separate cell for each bottle or can and a central handle panel for easily carrying the package. Typically, contact between adjacent cans or bottles is prevented by partitions which define the cells and by the center longitudinal partition.

Wrap around article carriers are commonly designed to have ends which are either partially or entirely open. In either case, the carriers are typically provided with some type of securement means for preventing the articles from falling out of the ends. Beverage cans, for example, are typically held in place partly by the tension of the tightly wrapped carrier and by engagement of the top and bottom flanges of the cans with the edges of cut outs provided in the side panels of the carrier through which the flanges of the cans extend.

Sleeve type carriers are typically manufactured from an elongated blank having a side panel section at one end and either the bottom panel section or the top panel section at the other end. The blank is formed into a flattened tube by folding the end sections in and adhering them to each other by a glue flap on one of the end sections. This flattened tube or collapsed carrier, as it is often called, is then shipped to a packaging plant where it is erected into a generally tubular shape, filled with the articles being packaged and then closed at its ends. The end panels are typically formed from end flaps connected to the top and bottom panels. When bottles are packaged in sleeve type carriers, the upper portions of the end panels are often made to taper inwardly toward the top panel to more closely conform to the shape of the bottles. An example of this latter type of article carrier is disclosed in U.S. Pat. No. 5,704,470 issued to Sutherland.

Exemplary of the previously discussed basket style article carriers is the article carrier described in U.S. Pat. No. 5,531,319 issued to Harrelson. A somewhat different type of basket style carrier is described in U.S. Pat. No. 5,538,130 also issued to Harrelson. One type of wrap around carrier of the character previously discussed is illustrated and described in U.S. Pat. No. 5,638,956 issued to Sutherland. Still another type of prior art wrap around carrier for packaging rows of articles is illustrated and described in U.S. Pat. No. 5,611,431 issued to Harris.

In some instances, it is desirable to package articles in two tiers. For example, on occasion it is desirable to package containers such as cans in two tiers rather than in a single layer. An example of such packaging is disclosed in U.S. Pat. No. 5,772,030 issued to Baxter.

A common drawback of many of the prior art article packages is the overall complexity of the package and the difficulty in retrieving articles one at a time from the package without destroying the integrity of the package. This is particularly true in carriers designed to contain articles stacked in tiers. Another drawback of certain of the prior art article carriers is their inability to protect against article movement and accidental carrier collapse. Finally, because of the complexity of manufacture of many of the prior art article packages, the cost of the package is often excessive.

It is these various deficiencies of prior art packaging that the present invention seeks to overcome by providing a simple yet sturdy, and easy to use article carrier for carrying various types of containers stacked in a plurality of tiers.

SUMMARY OF THE INVENTION

It is an object of the present invention to provide an article carrier that is inexpensive to produce and simple to form from a blank. More particularly, it is and object of the invention to provide such a carrier which is specially designed to permit easy packaging of articles such as pet food containers in a three-tier array.

Another object of the invention is to provide an article carrier of the aforementioned character which is easy to assemble from the formed blank, and when assembled provides a sturdy structure which can be easily transported and stored.

Another object of the invention is to provide an article carrier as described in the preceding paragraphs in which substantial portions of the packaged article are exposed to view while still maintaining the overall structural integrity of the carrier.

Another object of the invention is to provide an article carrier of the class described which does not contain individual article cells, but which nevertheless the less provides adequate strength and resistance to bowing and structural failure as the articles are removed from the container.

Another object of the invention is to provide an article carrier for packaging pet food containers in multiple tiers which can be conveniently opened at both ends so that the individual pet food containers can be easily accessed and removed from either end of the carton.

Another object of the invention is to provide an article carrier as described in the preceding paragraphs in which a convenient carrying strap is provided so that the article carrier and the pet food containers packaged therewithin can be readily transported from place to place.

Another object of the invention is to provide choices as to the manner in which the carrier is displayed or stored as dictated by the space available. For example, the carrier can be laid horizontally in which case the articles are removed upright, or alternatively, the carrier can be positioned vertically on a side panel so that the articles can be removed sideways.

DESCRIPTION OF THE INVENTION

Figure 7A:
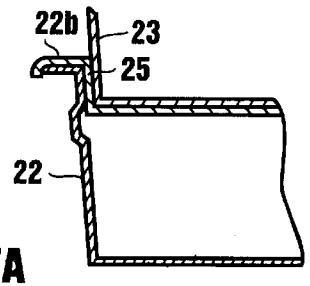
FIG. 7A is a greatly enlarged, cross-sectional view of the area designated as 7A in FIG. 7.
Figure 5:
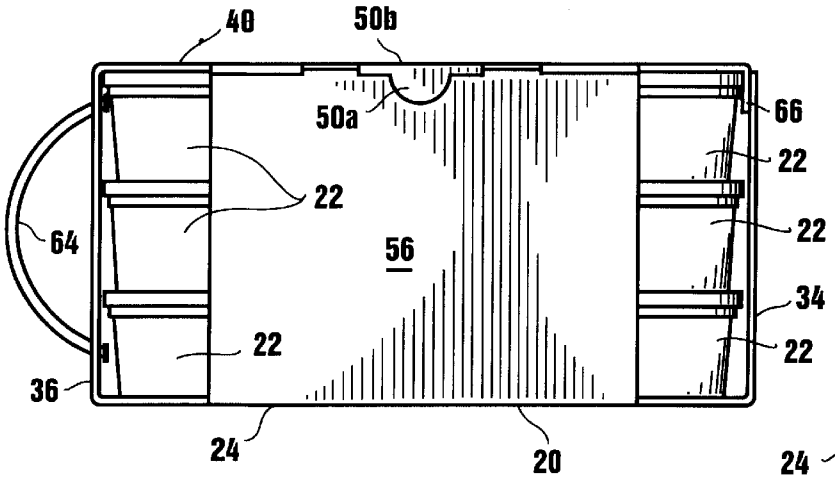
FIG. 5 is a rear view of the carton construction.
Figure 7:
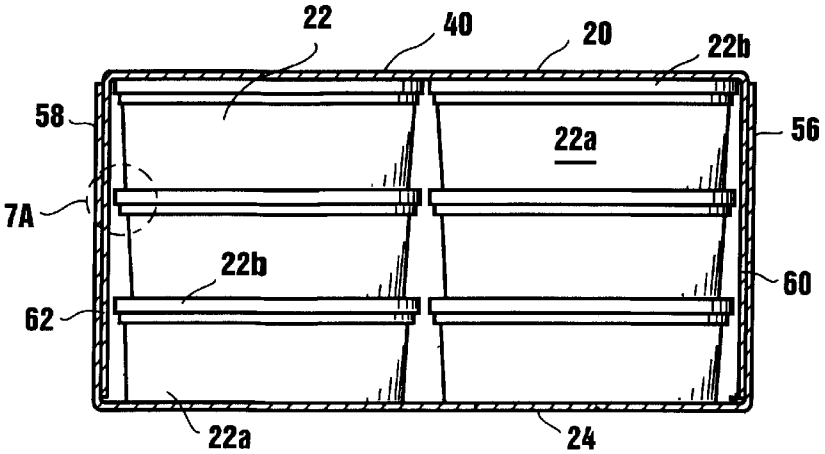
FIG. 7 is a cross-sectional view taken along lines 7—7 of FIG. 1.

Referring to the drawings and in particularly to FIGS. 1 through 7, one form of the carton of the invention for packaging a plurality of articles is there illustrated and generally designated by the numeral 20. In the embodiment of the invention shown in the drawings, the carton is uniquely designed to package a plurality of containers such as pet food containers 22 in a three tier configuration of the character best seen in FIGS. 1 and 7. As indicated in FIG. 7A, each of the containers 22 comprises a food containing body portion 22*a* and a closure lid 22*b*. When the containers 22 are stacked in the manner shown in FIG. 7, the bottom portion 23 of each of the stacked containers is received within the centrally concave portion 25 of the cover of the next adjacent container.

Figure 1:
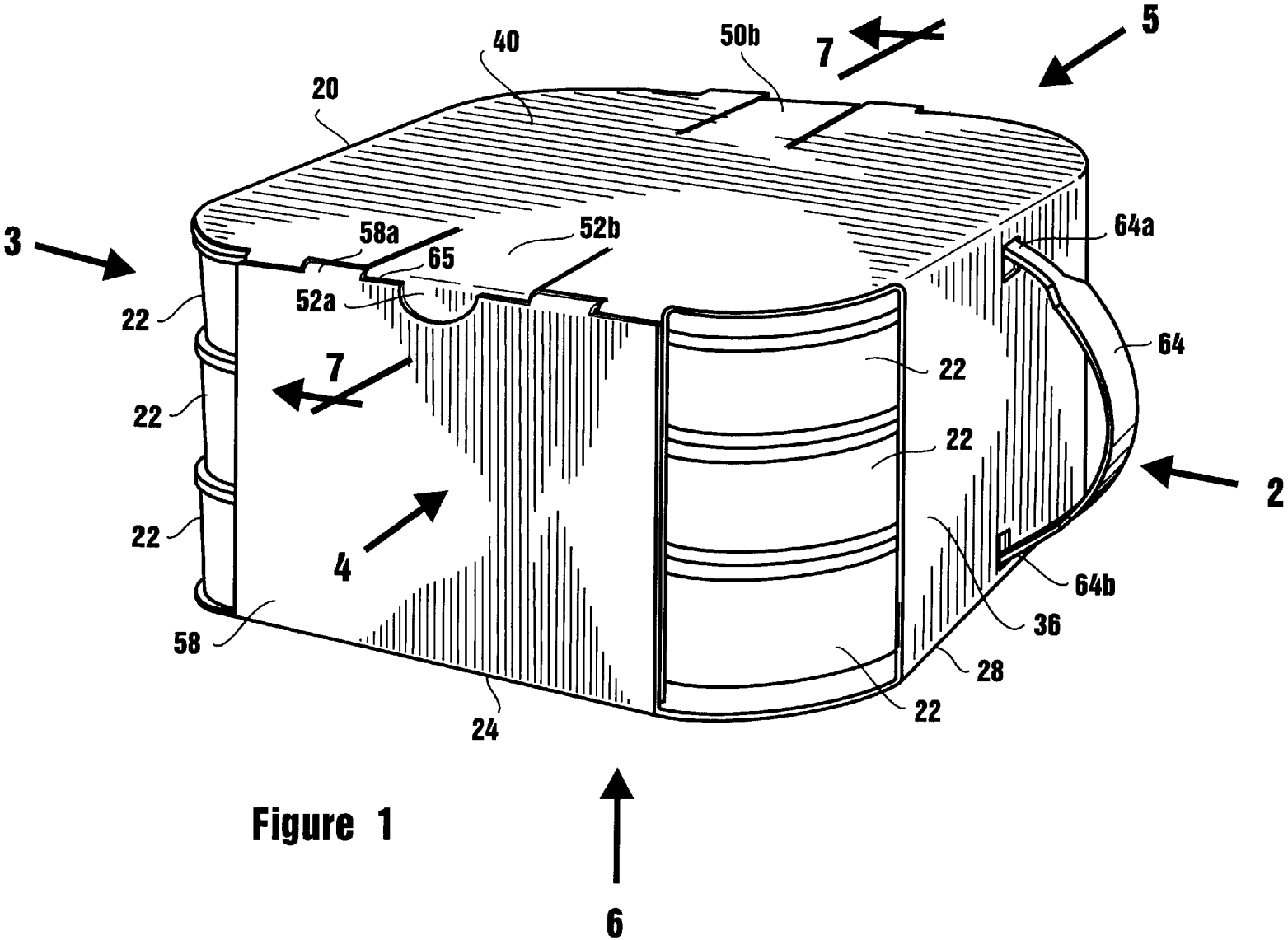
FIG. 1 is a generally perspective view of one form of the carton construction of the present invention.
Figure 2:
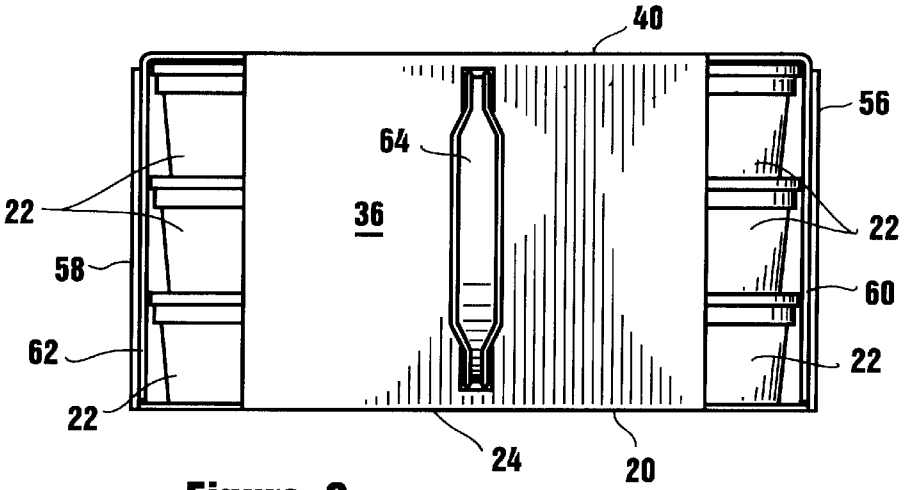
FIG. 2 is a right side view of the carton construction as illustrated in FIG. 1.
Figure 3:
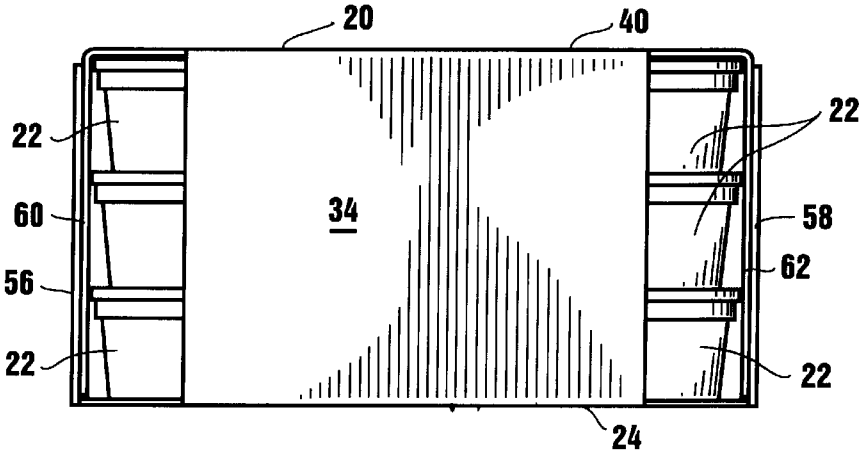
FIG. 3 is a left side view of the carton construction.
Figure 9:
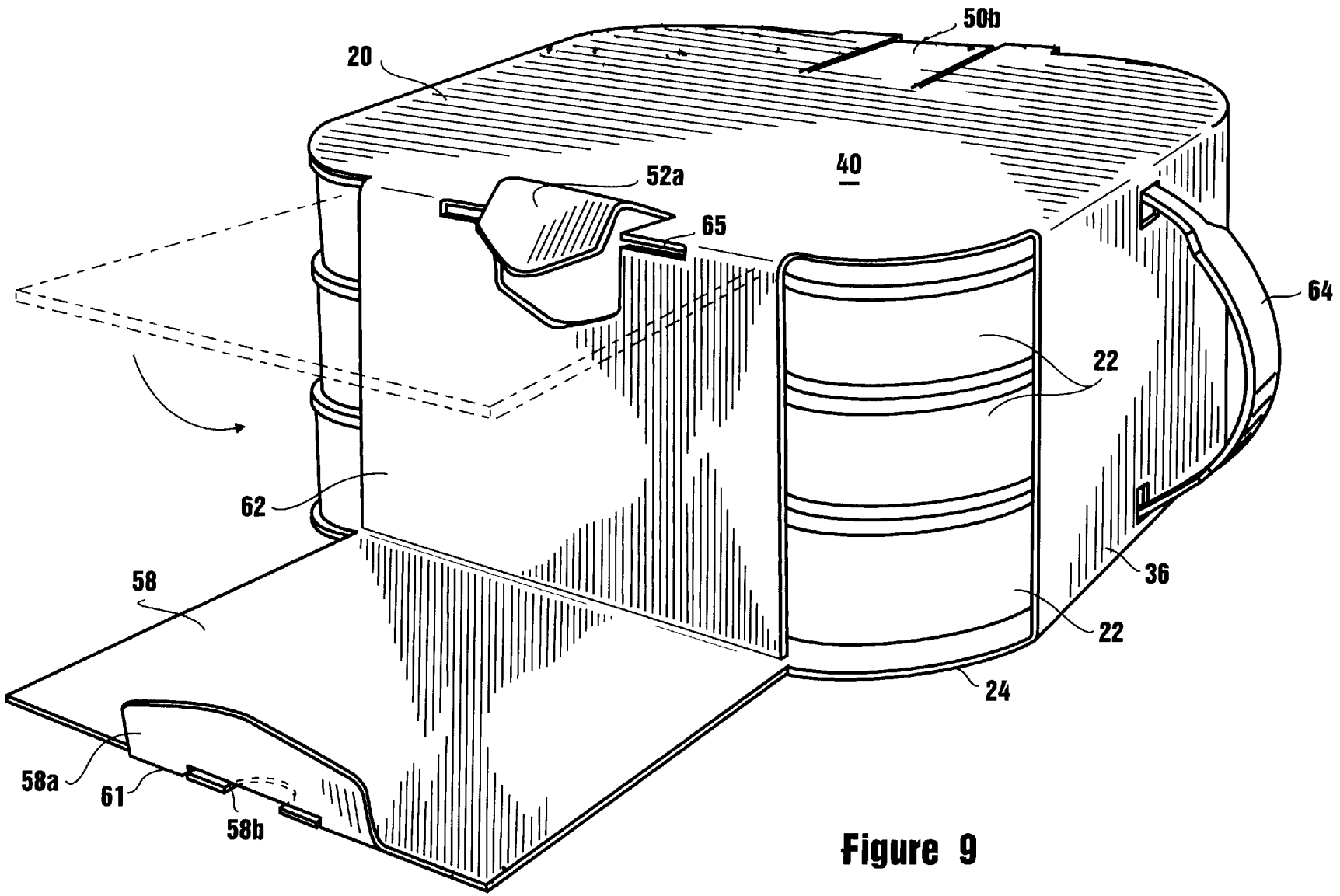
FIG. 9 is a generally perspective view of the carton construction illustrating the manner in which the front and rear panels can be opened to conveniently gain access to the containers housed within the container.

As illustrated in FIGS. 1 and 9, the carton of the invention is provided with open portions at each corner. These open portions are substantial in size so as to enable a clear view of the various containers stacked within the carton. As will be better understood by the discussion which follows, even though the viewing areas of each corner are of a substantial size, the structural integrity of the carton is in no way diminished.

As is indicated in FIGS. 1, 4, 5, and 9, a highly novel feature of the carton of the present invention is the easily openable opposing sides of the carton, which enables ready access to the various containers stacked within the carton in the three tiered relationship shown in the drawings.

Figure 8:
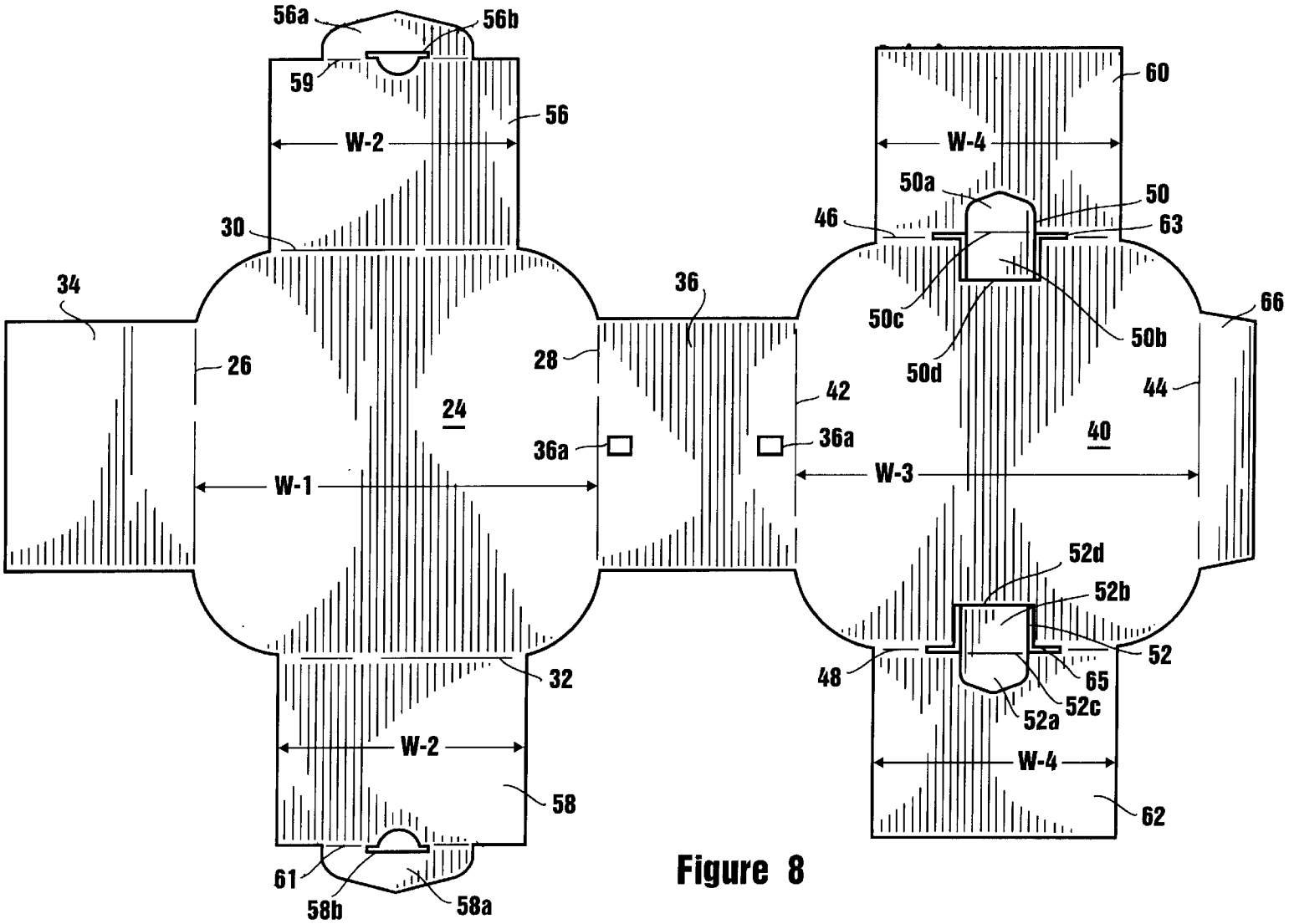
FIG. 8 is a top plan view of the unfolded paperboard blank or precursor construction of the carton of the present form of the invention.

Another unique feature of the apparatus of the invention resides in the fact that the carton can be constructed from a single sheet of paper board material which has been cut into the configuration shown in FIG. 8 of the drawings. Referring to FIG. 8 and also FIGS. 1 though 6, the carton of the present form of the invention can be seen to comprise a bottom wall 24, having opposed first and second side edges 26 and 28 respectively. Bottom wall 24 also has opposed first and second end edges 30 and 32 respectively. Foldably connected to the first side edge 26 of bottom wall 24, is a first side panel 34. In similar fashion, a second side panel 36 is foldably connected to second side edge 28 of bottom wall 24. Foldably connected to side panel 36 is a top wall designated in the drawings by the numeral 40. Top wall 40 has opposed first and second side edges 42 and 44 respectively and first and second end edges 46 and 48 respectively. As indicated in FIG. 8, side panel 36 is interconnected with top wall 40 by a fold line that is co-extensive with edge 42 of the top wall.

For reasons presently to be described, top wall 40 is provided with opposed first and second foldable connector tabs 50 and 52 respectively. Tab 50 comprises first and second portions 50*a* and 50*b* respectively which are interconnected along a fold line 50*c*. In similar fashion, tab 50 is interconnected with the body portion of top wall 40 along a fold line 50*d*. Foldable connector tab 52 also has a first portion 52*a* and a second portion 52*b*. Portions 52*a* and 52*b* are foldably interconnected along a fold line 52*c*. Connector tab 52, like connector tab 50 is interconnected with the body portion of top wall 40 along a fold line 52*d*.

Foldably connected to the first end edge 30 of bottom wall 24 is a first end panel 56. End panel 56 is foldable along edge 30 which forms a fold line about which end panel 56 can be folded relative to bottom wall 24. In similar fashion, a second end panel 58 is foldably connected to bottom wall 24 along edge 32 which also forms a fold line about which panel 58 can be folded relative to bottom wall 24. For purposes presently to be described, end panel 56 includes a foldable connector flap 56*a* which flap is provided with a slit 56*b* that is adapted to receive portion 50*a* of foldable connector tab 50 of top wall 40. In similar fashion, end panel 58 is provided with a foldable connector flap 58*a* which is provided with a slit 58*b* that is adapted to receive portion 52*a* of connector tab 52.

Foldably connected to first end edge 46 of top wall 40 is a third end panel 60 which is foldable relative to top wall 40 along a fold line which is co-extensive with edge 46. In similar fashion, a fourth end panel 62 is foldably connected to second edge 48 of top wall 40 and is foldable relative to top wall 40 along a fold line that is co-extensive with edge 48.

Figure 4:
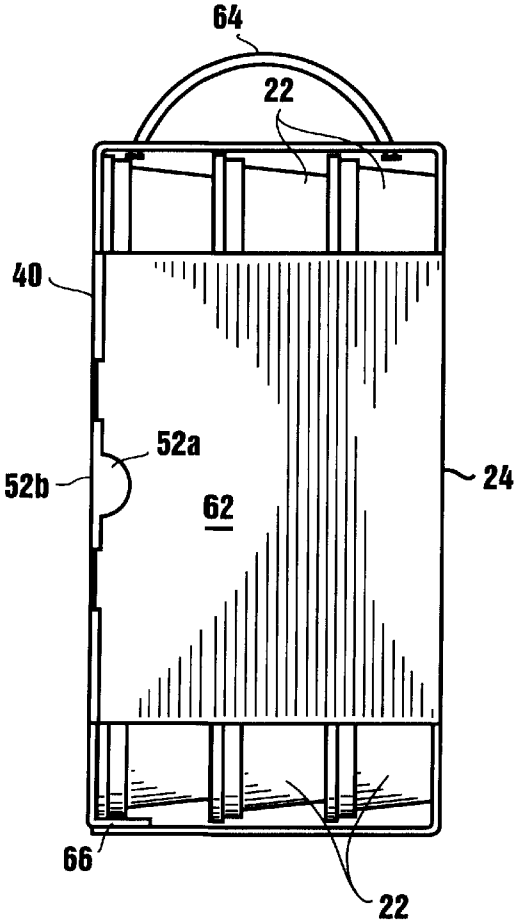
FIG. 4 is a front view of the carton construction.
Figure 6:
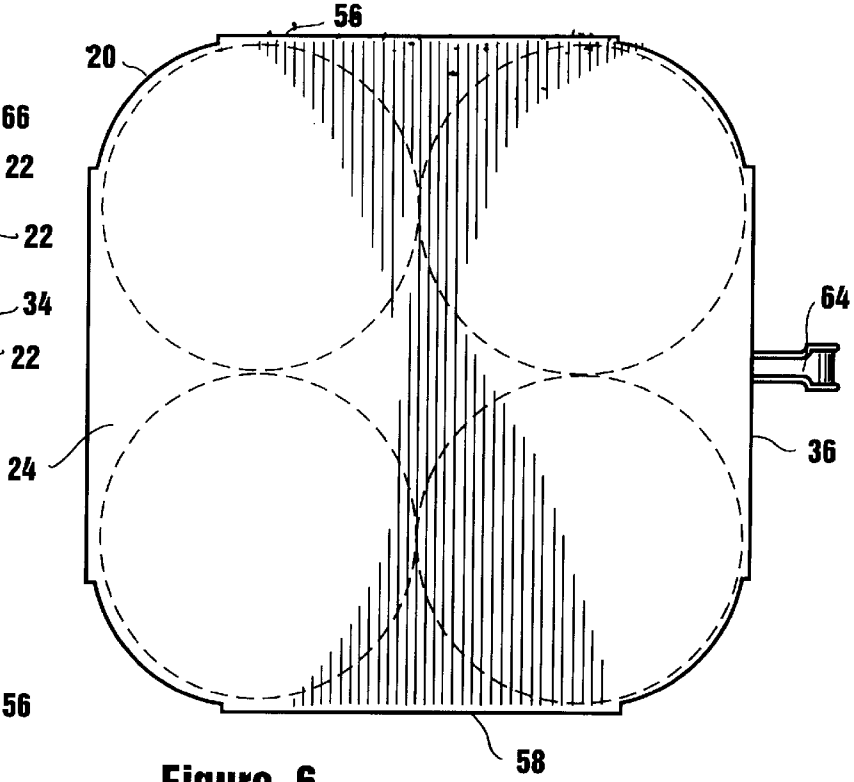
FIG. 6 is a bottom plan view of the carton construction shown in FIG. 1.

As illustrated in FIG. 8, panel 36 is provided with a pair of spaced apart apertures 36*a* which receive the yieldably deformable ends 64*a* and 64*b* of an elongated carrier strap 64. (FIG. 1) As shown in FIG. 4, end 64*a* and 64*b* include an enlarged end portion which is of a size and configuration so that upon twisting the ends of the carrying strap, the ends can be inserted into the apertures 62. Apertures 62 are of a configuration so that, upon releasing the ends of the carrying strap, it will remain securely anchored within the apertures until being once again twisted into a strap removal position.

Turning once again to FIG. 8, it is to be noted that bottom wall 24 has a first width, W1 and each of panels 56 and 58 have a second width W2 which is less than width W1. Similarly, top wall 40 has a first width W3 which is greater than the width W4 of end panels 60 and 62. With the construction thus described, when the precursor panel shown in FIG. 8 is folded into the configuration shown in FIGS. 1 through 7 and 9, the open, viewing corners are formed to enable a clear viewing of the several containers housed within the carton.

During the folding operation, a foldable stub wall 66, which forms a part of top wall 40, is folded so it extends downwardly from top wall 40 in a manner so that it can be interconnected as by adhesive bonding with panel 34 after panel 34 has been folded upwardly relative to bottom wall 24. (See for example FIG. 4). When panel 34 is thusly interconnected with stub wall 66, a generally tubular shaped structure is formed which is of the general character shown in FIGS. 4 and 5.

In constructing the erected carton of the invention from the planer precursor shown in FIG. 8, panel 34 is first folded upwardly along fold line 26 so it extends generally perpendicular to bottom wall 24. Next panel 36, along with bottom wall 40 is folded upwardly along fold line 28 so that the assemblage extends generally perpendicularly to bottom wall 24. This done, top wall 40 is folded about fold line 42 and stub wall 66 is, in turn, folded downwardly with respect to top wall 40. Stub wall 66 is then positioned interiorly of vertically extending panel 34 and is interconnected therewith by any suitable means such as adhesive bonding.

The next step in the carrier construction process is to fold panels 60 and 62 downwardly along fold lines 46 and 48 respectively from the position indicated by the phantom lines in FIG. 9 to that indicated by the solid lines in FIG. 9. This done, foldable connector flaps 56*a* and 58*a* are folded along fold lines 59 and 61 so that they extend generally vertically downwardly in the manner illustrated in FIG. 9. Next, both panels 56 and 58 are folded along fold lines 30 and 32 respectively to a position wherein the connector flaps can be inserted into slits 63 and 65 formed in panels 60 and 62 respectively. (FIG. 8) This done, portions 50*a* and 52*a* of the connector taps are folded downwardly and inserted into slots 56*b* and 58*b* respectively to complete the construction in the manner shown in FIG. 1.

With the precursor carton folded in the manner described in the preceding paragraphs, a rigid, sturdy and quite stable carton of the character shown in FIG. 1 is formed. When the carton thus constructed is used to store and transport containers 22 in the stacked arrays shown in FIG. 1, convenient access to the containers can be achieved from either side of the container by selectively removing tab portions 50*a* and 52*a* from slots 56*b* and 58*b* and then by removing connector tabs 56*a* and 58*a* from slits 63 and 65. This done, a selected one of chosen panels 56 or 58 can be folded into an open configuration to permit upward folding of panels 60 or 62 and then to permit easy removal of the pet food containers from the interior of the carton. So long as tabs 56*a*, 58*a*, 50*a* and 52*a* are in their interlocked positions as shown in FIG. 1, the carton can be easily transported from place to place with the pet foot containers secured therewithin

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. A carton for packaging a plurality of containers arranged in multiple tiers comprising:

(a) a bottom wall having opposed first and second side edges and opposed first and second end edges;

(b) a first side panel connected to said first side edge of said bottom wall;

(c) a second side panel connected to said second side edge of said bottom wall;

(d) a top wall having opposed first and second side edges and opposed first and second end edges, said second side panel being connected to said first side edge of said top wall and said first side panel being connected to said second side edge of said top wall to form a generally tubular structure, said top wall also having opposed first and second foldable connector tabs disposed proximate said first and second end edges respectively;

(e) a first end panel connected to said first end edge of said bottom wall, said first end panel having a slit for receiving at least a portion of said first foldable connector tab of said top wall;

(f) a second end panel connected to said second end edge of said bottom wall, said second end panel having a slit for receiving at least a portion of said second foldable connector tab of said top wall;

(g) a third end panel connected to said first end edge of said top wall, said third end panel having a flap-receiving slit formed therein; and (h) a fourth end panel connected to said second end edge of said top wall, said fourth end panel having a flap-receiving slit formed therein; wherein each of first and second end panels include a foldable connector flap receivable within a selected one of said flap receiving slits formed in said third and fourth end panels.

2. The carton as defined in claim 1 further including a carrying strap connected to a selected one of said first and second side panels.

3. A carton for packaging a plurality of containers arranged in multiple tiers comprising:

(a) a bottom wall having opposed first and second side edges and opposed first and second end edges;

(b) a first side panel connected to said first side edge of said bottom wall;

(c) a second side panel connected to said second side edge of said bottom wall;

(d) a top wall having opposed first and second side edges and opposed first and second end edges, said second side panel being connected to said first side edge of said top wall and said first side panel being connected to said second side edge of aid top wall to form a generally tubular structure, said top wall also having opposed first and second foldable connector tabs disposed proximate said first and second end edges respectively;

(e) a first end panel connected to said first end edge of said bottom wall, said first end panel including a foldable connector flap having a slit for receiving at least a portion of said first foldable connector tab of said top wall;

(f) a second end panel connected to said second end edge of said bottom wall, said second end panel including a fordable connector flap having a slit for receiving at least a portion of said second foldable connector tab of said top wall;

(g) a third end panel connected to said first end edge of said top wall, said third end panel having a flap-receiving slit formed therein for receiving at least a portion of said foldable connector flap of said first end panel;

(h) a fourth end panel connected to said second end edge of said top wall, said fourth end panel having a flap-receiving slit formed therein for receiving said foldable connector flap of said second end panel; and (i) a carrying strap connected to a selected one of said first and second side panels.

4. The carton as defined in claim 3 further including a foldable stub wall connected to said second side edge of said top wall for interconnection with said first side panel.

5. The carton as defined in claim 3 in which said second side panel is provided with spaced-apart, strap-receiving apertures and in which said carrying strap has a first end receivable within a selected one of said strap receiving apertures in said second side panel and a second end receivable within the other of said strap receiving apertures in said second side panel.

6. The carton as defined in claim 3 in which said bottom wall has a first width and in which each of said first and second end panels have a second width less than said first width.

7. The carton as defined in claim 3 in which said top wall has a first width and in which each of said third and fourth end panels have a second width less than said first width.

8. The carton as defined in claim 3 in which said first and second foldable connector tabs each include a first portion and a second portion foldable relative to said first portion along an intermediate fold line.

9. The carton as defined in claim 8 in which said second portions of said foldable connector tabs are receivable within said tab-receiving slits of said foldable connector flaps.

10. A carton for packaging a plurality of containers arranged in three tiers comprising:

(a) a bottom wall having opposed first and second side edges and opposed first and second end edges, said bottom wall being of a first width;

(b) a first side panel connected to said first side edge of said bottom wall, said first side panel being of a second width less than said first width;

(c) a second side panel connected to said second side edge of said bottom wall, said second side panel being of a width less than said first width, said second side panel having a pair of spaced-apart apertures;

(d) a top wall having opposed first and second side edges and opposed first and second end edges, said second side panel being connected to said first side edge of said top wall and said first side panel being connected to said second side edge of aid top wall to form a generally tubular structure, said top wall being of a first width and also having opposed first and second foldable connector tabs disposed proximate said first and second end edges respectively, each said connector tab having a first and second portion;

(e) a first end panel connected to said first end edge of said bottom wall, said first end panel including a foldable connector flap having a slit for receiving said first portion of said first foldable connector tab of said top wall, said first end wall being of a width less than said first width;

(f) a second end panel connected to said second end edge of said bottom wall, said second end panel including a fordable connector flap having a slit for receiving said second foldable connector tab of said top wall, said second end panel being of a width less than said first width;

(g) a third end panel connected to said first end edge of said top wall, said third end panel having a flap-receiving slit formed therein for receiving at least a portion of said foldable connector flap of said first end panel, said third end panel being of a width less than said first width;

(h) a fourth end panel connected to said second end edge of said top wall, said fourth end panel having a flap-receiving slit formed therein for receiving said foldable connector flap of said second end panel, said fourth end panel being of a width less than said first width;

(i) a carrying strap having end portions lockably receivable within said apertures of said second side panel.

11. The carton as defined in claim 10 in which said second portion of said first and second foldable connector tabs are foldable relative to said first portions thereof.

12. The carton as defined in claim 11 in which said second portions of said foldable connector tabs are receivable within said tab-receiving slits of said foldable connector flaps.

* * * * *